US006010395A

United States Patent [19]

Nakajima

[11] Patent Number: 6,010,395

[45] Date of Patent: Jan. 4, 2000

[54] CHEMICAL-MECHANICAL POLISHING APPARATUS

[75] Inventor: Hideharu Nakajima, Kanagawa, Japan

[73] Assignee: Sony Corporation, Tokyo, Japan

[21] Appl. No.: 09/084,368

[22] Filed: May 27, 1998

[30] Foreign Application Priority Data

May 28, 1997 [JP] Japan ..... 9-138791

[51] Int. Cl.[7] ..... B24B 5/00

[52] U.S. Cl. ..... 451/287; 451/527

[58] Field of Search ..... 451/526, 527, 451/528, 530, 533, 285, 288, 921

[56] References Cited

U.S. PATENT DOCUMENTS 5,297,364 3/1994 Tuttle ..... 51/209 R
5,329,734 7/1994 Yu ..... 51/283 R
5,672,095 9/1997 Morimoto et al. ..... 451/41
5,795,218 8/1998 Doan et al. ..... 451/526
5,853,317 12/1998 Yamamoto ..... 451/288

*Primary Examiner*—David A. Scherbel
*Assistant Examiner*—Dung Van Nguyen
*Attorney, Agent, or Firm*—Hill & Simpson

[57] ABSTRACT

Disclosed is a chemical-mechanical polishing apparatus having a polishing cloth enabling planarization in which occurrence of mictoscracthes is suppressed without the need of provision of a dressing step. The apparatus basically includes a turn table on which a polishing cloth is mounted, a holding base for holding a substrate to be processed, and a polishing solution supply unit. The surface of the polishing cloth has irregularities formed by arranging a large number of truncated cone-shaped small holes in a delta-shaped pattern at specific intervals. The depth of the small holes is set at about 800 $\mu$m and the interval is set at about 300 $\mu$m. Such an apparatus is effective to improve the yield in fabrication of highly integrated semiconductor devices using the apparatus at a planarization step.

17 Claims, 4 Drawing Sheets

CHEMICAL-MECHANICAL POLISHING APPARATUS

BACKGROUND OF THE INVENTION

The present invention relates to a chemical-mechanical polishing apparatus, and particularly to a chemical-mechanical polishing apparatus characterized by a polishing cloth.

Recently, along with higher integration of semiconductor devices, it has been increasingly required to improve a technique for finely processing the semiconductor devices. To form a fine pattern of a photoresist which is essential to the above technique for finely processing semiconductor devices, studies have been extensively made to develop a photoresist having a high sensitivity and a high resolution and also to develop a high resolution exposure system. However, if a surface of a film to be processed is not flat, a photoresist within an exposure region cannot be accurately, finely patterned owing to a relationship between the flatness of the film surface and a focal depth of the exposure system and/or the performance of the photoresist.

Not only to meet the requirement for the above-described fine processing, but also to meet a requirement for step coverage of a film to be processed such as an interconnection film formed on an underlaying layer being not flat, it has been required to develop a technique for planarizing the surface of the underlying layer formed under the film to be processed, and a CPM (Chemical-Mechanical Polishing) process has been known as a preferable planarization technique.

An apparatus used for planarizing a surface to be processed by the above-described CMP process is a CMP apparatus to which the present invention pertains.

First, a related art CMP apparatus and a process using the CMP apparatus will be described with reference to FIG. 4.

As shown in FIG. 4, a CMP apparatus 1 mainly includes a turn table 10, a holding base 20, a dressing plate 30, and a polishing solution supply unit 40. The turn table 10 on which a polishing cloth 12 is stuck is rotatably supported by a turning shaft 11. The holding base 20 on which a substrate to be processed such as a semiconductor wafer 22 is held is rotatably supported by a turning shaft 21 and is applied with a pressure through the turning shaft 21. The dressing plate 30, which is adapted to coarsen the polishing cloth 12, is rotatably supported by a turning shaft 31 and is applied with a pressure through the turning shaft 31.

The surface of the turn table 10 on which the polishing cloth 12 is stuck is finished at a very high flatness because it becomes a reference plane. The polishing cloth 12 is made from a hard resin such as a polyurethane resin containing small foams.

The semiconductor wafer 22 is stuck on an underside of the holding base 20 with a sticking material such as sticky wax or a wafer packing film or it is stuck on the underside of the holding base 20 by vacuum-attraction. The semiconductor wafer 22 is polished by the polishing cloth 12 stuck on the turn table 10 in a state in which the semiconductor wafer 22 is pressed on the polishing cloth 12 by a pressure applied from a polishing pressure regulator (not shown) through the turning shaft 21.

On the underside of the dressing plate 30 are fixedly bonded hard grains 32 of a hard ceramic, diamond or the like. The surface of the polishing cloth 12 is coarsened (dressed) in a state in which both the dressing plate 30 and the turn table 10 are rotated and the dressing plate 30 is pressed on the polishing cloth 12 stuck on the turn table 10 by a pressure applied to the dressing plate 30.

The polishing solution supply unit 40 is used to supply a polishing solution (slurry) on the polishing cloth 12 stuck on the turn table 10 through a leading end of a supply nozzle 41. The polishing solution contains small abrasive grains such as silica grains dispersed in an alkali solution such as aqueous ammonia.

An operation for polishing a semiconductor wafer using the CMP apparatus 1 will be described below.

First, the polishing cloth 12 stuck on the turn table 10 is dressed by rotating both the turn table 10 and the dressing plate 30, and moving down the dressing plate 30 to press the dressing plate 30 on the polishing cloth 12 stuck on the turn table 10 at a specific pressure, whereby the surface of the polishing cloth 12 is scratched with the hard grains 32 fixedly bonded on the underside of the dressing plate 30. With the dressing continued for a specific time, numberless small irregularities 12*a* are formed on the surface of the polishing cloth 12 due to numberless scratches, to make fuzzy the surface of the polishing cloth 12.

After the surface of the polishing cloth 12 is dressed for the specific time, the dressing plate 30 is moved up, followed by stoppage of rotation of both the dressing plate 30 and the turn table 10.

Then, the semiconductor wafer 22 is stuck on the underside of the holding base 20 with a surface to be processed downward, and a pressure to be applied from the polishing pressure regulator (not shown) to the holding base 20 is set.

The turn table 10 is rotated, and the polishing solution is supplied from the leading end of the supply nozzle 41 of the polishing solution supply unit 40 on a central portion of the polishing cloth 12 stuck on the turn table 10. The polishing solution supplied from the leading end of the supply nozzle 41 is spread over the entire surface of the polishing cloth 12 by a centrifugal force caused by rotation of the turn table 10.

The holding base 20 on which the semiconductor wafer 22 is stuck is rotated, and is moved down to press the surface to be processed of the semiconductor wafer 22 on the polishing cloth 12 stuck on the turn table 10 at a specific pressure.

In the state in which the surface to be processed of the semiconductor wafer 22 is pressed on the polishing cloth 12, the polishing solution is carried onto the surface to be processed of the semiconductor wafer 22 through the irregularities 12*a* formed on the surface of the polishing cloth 12, to polish the surface to be processed of the semiconductor wafer 22, thus planarizing the surface to be processed.

After the surface to be processed of the semiconductor wafer 22 is polished a specific amount, the holding base 20 is moved up, followed by stoppage of rotation of the holding base 20 and the turn table 10 and stoppage of supply of the polishing solution. Then, the semiconductor wafer 22 is separated from the underside of the holding base 20.

In this way, surfaces to be processed of semiconductor wafers 22 are sequentially planarized by repeating the above steps of sticking a semiconductor wafer 22 on the holding base 20, planarizing a surface to be processed of the semiconductor wafer 22, and separating the semiconductor wafer 22 from the underside of the holding base 20.

The result of planarizing a large number of semiconductor wafers 22 causes wear of irregularities of the polishing cloth 12. This deteriorates the performance of supplying the polishing solution on a surface to be processed of a semiconductor wafer 22, to thereby degrade a rate of planarizing the surface to be processed and to make poor the flatness. For this reason, after planarization of a specific number of semiconductor wafers 22, the polishing cloth 12 is dressed by the dressing plate 20 in the same manner as described above.

In planarization of surfaces to be processed of semiconductor wafers 22 by the CMP apparatus 1, for suppressing occurrence of micro-scratches on a surface to be processed of a semiconductor wafer 22, it is necessary to quickly remove, from the surface of a polishing cloth 12, shavings of the polishing cloth 12 and hard grains 32 peeled from the underside of the dressing plate 30 upon dressing and also large grains such as flakes of silicon produced upon planarization of the semiconductor wafer 22, and to supply a new polishing solution to the surface to be processed of the semiconductor wafer 22 pressed on the polishing cloth 12. This causes a problem that a large amount of the polishing solution is consumed, to thereby increase the production cost in fabrication of semiconductor devices.

Further, in planarization of surfaces to be processed of semiconductor wafers 22 by the CMP apparatus 1, as described above, the polishing cloth 12 must be dressed after planarization of a specific number of semiconductor wafers 22 for preventing the deterioration of the flatness of a surface to be processed upon planarization. This degrades the working ratio of planarization by the CMP apparatus 1, and also requires exchange of the dressing plate 30 because the dressing performance of the dressing plate 30 is gradually deteriorated. This causes a problem in increasing the number of works and the production cost due to exchange of the dressing plate 30.

SUMMARY OF THE INVENTION

An object of the present invention is to solve the problems of the above-described related art chemical-mechanical polishing apparatus and a chemical-mechanical process using the same, and to provide a chemical-mechanical polishing apparatus having a polishing cloth enabling planarization in which occurrence of micro-scratches is suppressed without the need of provision of the dressing step.

To achieve the above object, according to the present invention, there is provided a chemical-mechanical polishing apparatus including: a polishing cloth in which a plurality of small holes having a specific depth are arranged at specific intervals; a turn table on which the polishing cloth is mounted; a holding base for holding a substrate to be processed; and a polishing solution supply unit for supplying a polishing solution.

In the above polishing cloth, a ratio of an area of the polishing cloth excluding the small holes to a total area of the polishing cloth may be 60% or less, preferably, 58.8% or less.

With this configuration, since the step of dressing a polishing cloth by a dressing plate can be omitted, the working ratio of the chemical-mechanical polishing apparatus can be improved.

Since the dressing step is not required to be provided, it is possible to eliminate the cause of occurrence of microscratches on a surface to be processed of a semiconductor wafer as a substrate to be processed due to shavings of a polishing cloth and large grains such as hard grains peeled from the underside of the dressing plate upon dressing of the polishing cloth, and further, since a surface to be processed of a semiconductor wafer is prevented from being in contact with large grains such as flakes of silicon produced upon planarization of the semiconductor wafer by setting the depth of the small holes to be more than the opening diameter of the small holes, it is possible to reduce the cause of occurrence of microscratches due to the large grains. This is effective to improve the yield in fabrication of highly integrated semiconductor devices using the above chemical-mechanical polishing apparatus at the planarization step.

DETAILED DESCRIPTION OF THE PREFERRED EMBODIMENT

Figure 2A:
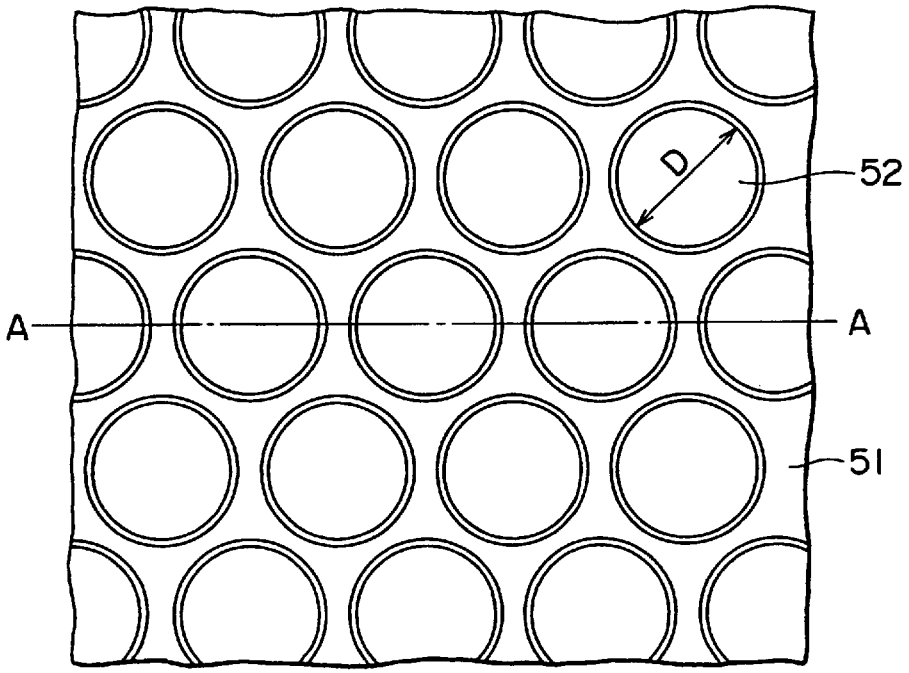
FIG. 2A is a schematic plan view of a polishing cloth used for the chemical-mechanical polishing apparatus shown in FIG. 1.
Figure 2B:
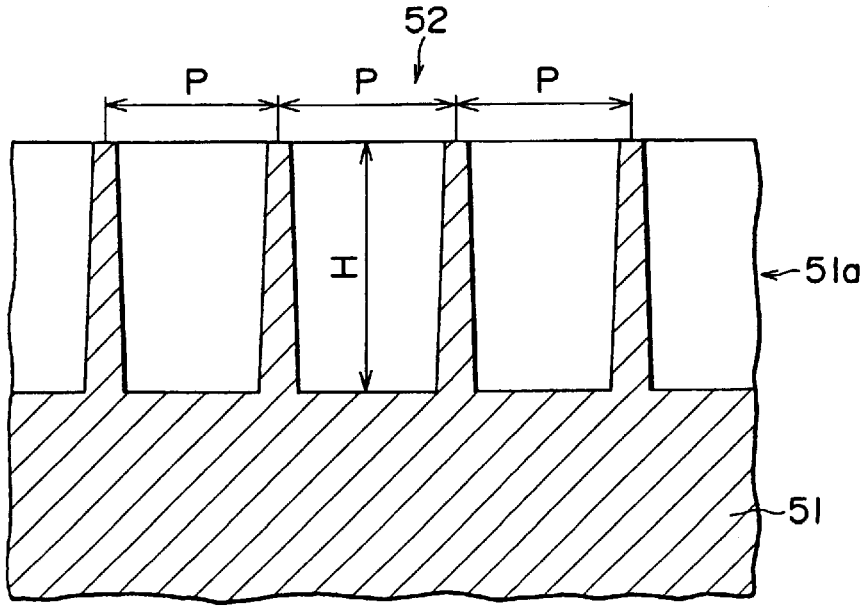
FIG. 2B is a schematic sectional view taken on line A—A of FIG. 2A.
Figure 3:
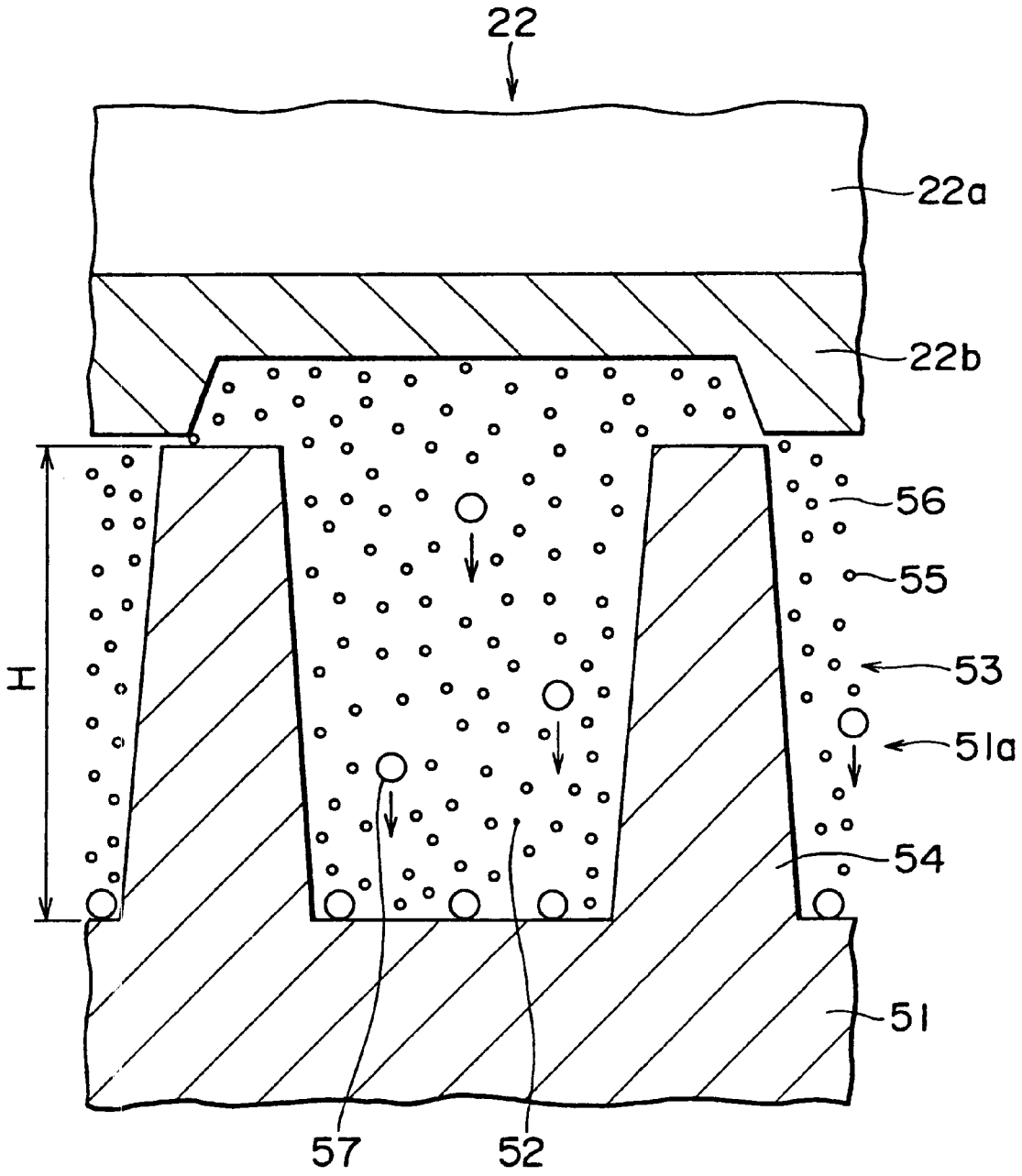
FIG. 3 is a schematic sectional view of a surface to be processed of a semiconductor wafer and its neighborhood, illustrating a state of planarization by the CMP apparatus shown in FIG. 1.

Hereinafter, a preferred embodiment of the present invention will be described in detail with reference to FIGS. 1 to 3. In these figures, parts corresponding to those described with reference to FIG. 4 are indicated by the same reference numerals as those in FIG. 4.

In this embodiment, the present invention is applied to a chemical-mechanical polishing (CMP) apparatus for planarizing a surface to be processed of a substrate to be processed in accordance with a chemical-mechanical polishing (CMP) process.

Figure 1:
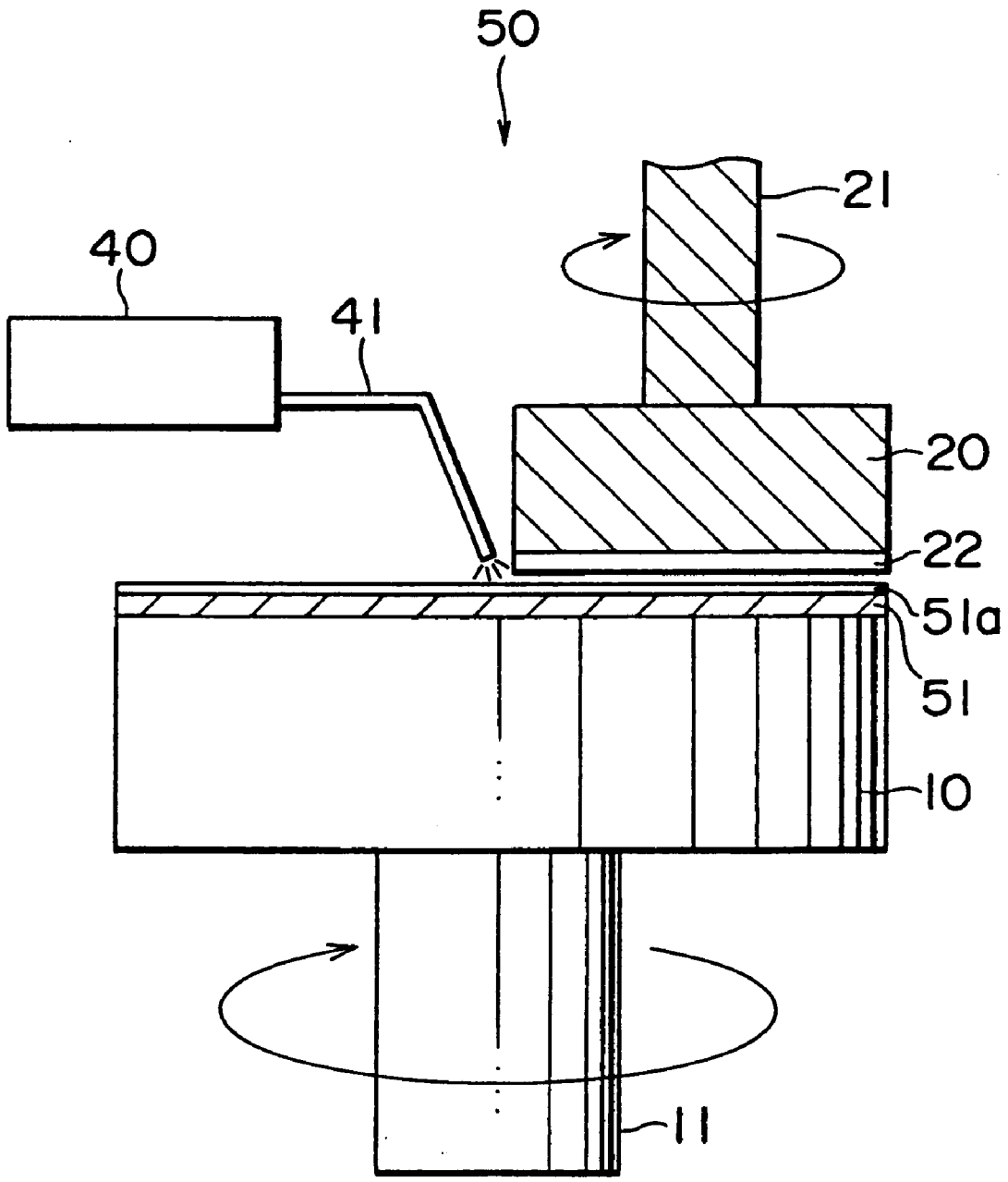
FIG. 1 is a schematic sectional view of a CMP apparatus according to an embodiment of the present invention.

Referring to FIG. 1, a CMP apparatus 50 basically includes a turn table 10, a holding base 20, and a polishing solution supply unit 40. The turn table 10 on which a polishing cloth 51 of the present invention is mounted is rotatably supported by a turning shaft 11. The holding base 20 on which a substrate to be processed, for example, a semiconductor wafer 22 is held is rotatably supported by a turning shaft 21 and is applied with a pressure through the turning shaft 21.

Figure 4:
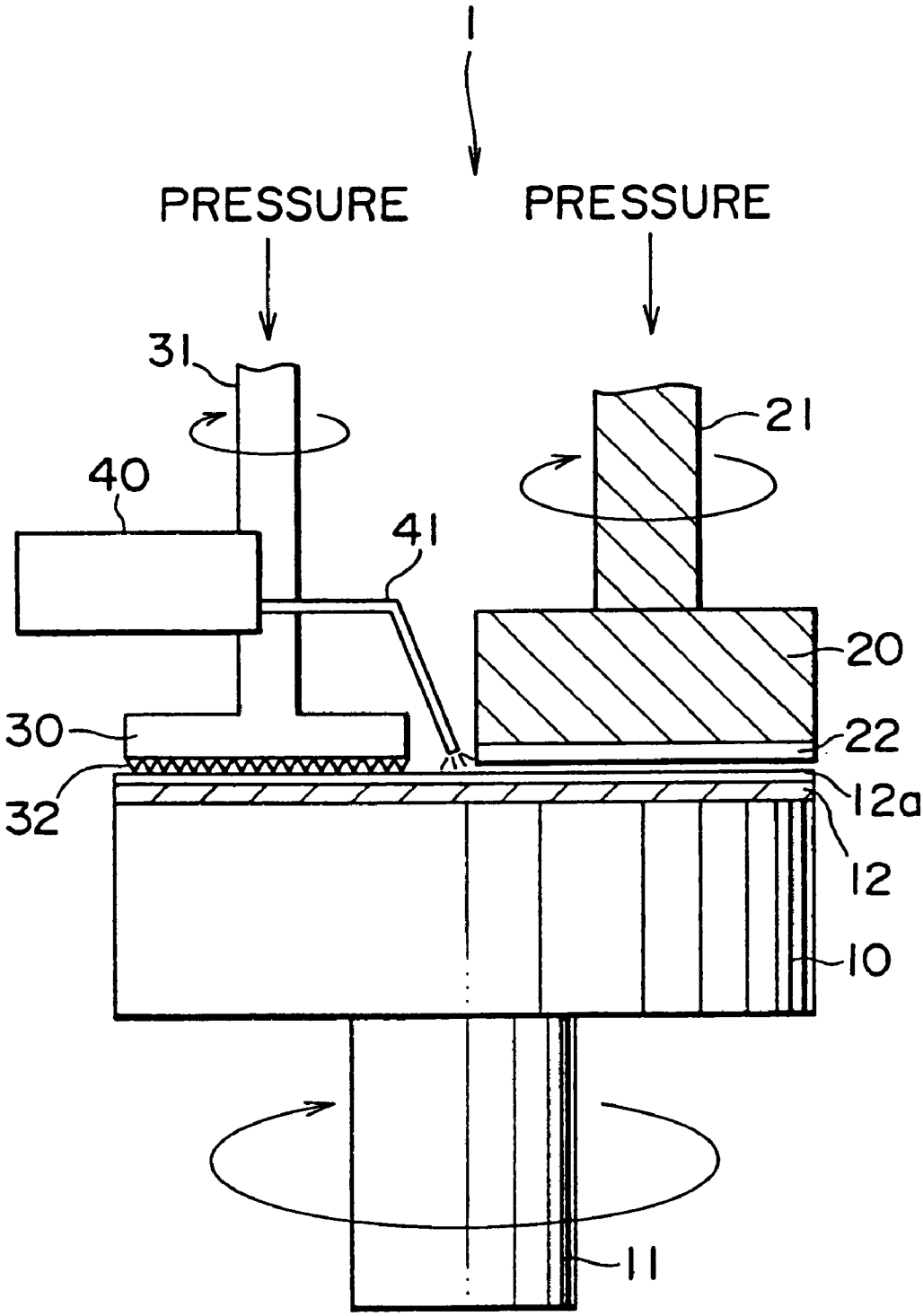
FIG. 4 is a schematic sectional view of a related art CMP apparatus.

It should be noted that the CMP apparatus 50 in this embodiment is not provided with the dressing plate 30 which is an essential component of the related art CMP apparatus 1 (see FIG. 4).

The basic components of the CMP apparatus 50 being the same as those of the related art CMP apparatus 1 have the same functions, and therefore, the explanation thereof is omitted. Here, only the function of a characteristic component of this embodiment will be described in detail.

As shown in FIG. 1, the polishing cloth 51 of the present invention is formed into a circular shape having a diameter nearly equal to that of the circular turn table 10, and a surface portion of the polishing cloth 51 has irregularities 51*a* obtained by formation of a large number of small holes.

The detailed structure of the polishing cloth 51 will be described with reference to FIGS. 2A and 2B. FIG. 2A is a schematic plan view seen from top, of a portion of the polishing cloth 51, and FIG. 2B is a schematic sectional view taken on line A—A of FIG. 2A.

The polishing cloth 51 is made from, for example, a hard resin such as a polyurethane resin, and has a thickness of, for example, about 3 mm. The surface portion of the polishing cloth 51 has the irregularities 51*a* obtained by formation of a large number of the small holes 52. Here, the small holes 52 having a specific depth are arranged at specific intervals.

It is to be noted that if there is a possibility that the hardness of the polishing cloth 51 made from a hard resin is too high to degrade a global flatness of a semiconductor wafer 22, the polishing cloth 51 may be formed by lamination of a hard resin cloth and a soft resin cloth.

In a preferred example of the structure of the polishing cloth 51*a,* the specific depth of the small holes 52 is set at about 800 μm and the specific interval P between the small holes 52 is set at about 300 μm; each small hole 52 is formed into a truncated cone shape having a surface diameter of about 250 μm and a bottom diameter of about 200 μm; and the small holes 52 are arranged in a delta-shaped pattern.

The above-described arrangement and shape of the small holes 52 of the polishing cloth 51 are described for illustrative purposes only, and therefore, the present invention is not limited thereto. For example, since planarization is performed by mutual rotation of the turn table 10 and the holding base 20, the small holes 52 may be freely arranged, for example, in a grid-like pattern or the like insofar as they are substantially uniformly arranged; and the surface shape of each small hole 52 may be an elliptic shape, a rectangular shape, or the like.

The polishing cloth 51 is formed by a usual resin molding process. For example, there may be used a process of preparing a resin molding die engraved to form the irregularities 51*a* of the polishing cloth 51, and injecting a polyurethane resin molten by heating into the molding die in such a manner as to prevent entrapment of air in the molten resin; or a process of heating a die engraved to form the irregularities 51*a* of the polishing cloth 51, and pressing the heated die on a polyurethane resin sheet placed on a flat plate.

The state of planarization by the CMP apparatus 50 using the polishing cloth 51 will be described with reference to FIG. 3.

Upon start of planarization, a surface to be processed of a semiconductor wafer 22, more specifically, a surface of an interlayer insulating film 22*b* on a semiconductor substrate 22*a* has irregularities of, for example, about 1 μm, and such a surface of the interlayer insulating film 22*b* is in contact with a projection of the irregularities 51*a* on the surface of the polishing cloth 51, that is, an upper surface of a peripheral portion 54 of the small hole 52. Then, abrasive grains 55 having an average grain size of, for example, about 20 μm and an alkali solution 56 are entrapped in a portion at which the upper surface of the interlayer insulating film 22*b* is in contact with the upper surface of the peripheral portion 54 by both movement of the semiconductor wafer 22 due to rotation of the holding base 20 and movement of the polishing cloth 51 due to rotation of the turn table 10, whereby the surface of the interlayer insulating film 22*b* is subjected to chemical-mechanical polishing.

During a period of time in which the semiconductor wafer 22 is over a small hole 52, that is, the small hole 22 is directly under the holding base 20, the concentration of the alkali solution 56 of the polishing solution 53 in the small hole 52 is lowered by chemical-mechanical polishing; however, when the small hole 52 is separated from the position directly under the holding base 20, the small hole 52 is resupplied with a new polishing solution 53 continuously supplied to the central portion of the polishing cloth 51 from the polishing solution supply unit 40. Accordingly, the lowering of the concentration of the alkali solution of the polishing solution 53 in the small hole 52 is suppressed, to thereby suppress a reduction in polishing rate.

Large grains 57 each having a size of about 1 μm or more, such as flakes of silicon in the polishing solution 53 in the small hole 52, large-sized grains each being grown by aggregation of small abrasive grains 55 for some reasons, or large-sized dust particles in the polishing solution 53 are sunk by gravity to be thus deposited on the bottom of the small hole 52. If the large grains 57 are entrapped in a portion at which the upper surface of the interlayer insulating film 22*b* is in contact with the upper surface of the peripheral portion 54, there is a possibility of occurrence of microscratches on the upper surface of the interlayer insulating film 22*b*; however, as described above, since the large grains 57 are sunk and deposited on the bottom of the small hole 52, it is possible to suppress occurrence of microscratches.

To deposit the large grains 57 on the bottom of the small hole 52 and to prevent the large grains 57 to be moved upward in the small hole 52, the depth H of the small hole 52 may be set larger; however, if the depth H of the small hole 52 is excessively larger than the diameter of the small hole 52, the resupply characteristic of the alkali solution 56 is made poor, to lower the concentration of the alkali solution 56 of the polishing solution in the small hole 52 and also lower a dispersion ratio of the deposited abrasive grains 55, thereby reducing the planarizing rate and degrading the flatness of a semiconductor wafer. As a result, the specific depth H of the small hole 52 may be set in a range of 30 μm≦H≦5 mm, preferably, in a range of 30 μm≦H≦3 mm, more preferably, in a range of 30 μm≦H≦2 mm, and the specific interval P between the small holes 52 may be set in a range of 20 μm ≦P≦5 mm, preferably, in a range of 20 μm≦P≦3 mm, more preferably, in a range of 20 μm≦P≦2 mm. To meet the above requirements, as described above, in the preferred example of the structure of the irregularities 51*a* of the polishing cloth 51, the specific depth H of the small holes 52 is set at about 800 μm and the specific interval P between the small holes 52 is set at about 300 μm; each small hole 52 is formed into a truncated cone shape having a surface diameter of about 250 μm and a bottom diameter of about 200 μm; and the small holes 52 are arranged in a delta-shaped pattern.

An operation of polishing a semiconductor wafer by the CMP apparatus 50 will be described below.

First, a semiconductor wafer 22 is stuck on the underside of the holding base 20 with a surface to be processed of the semiconductor wafer 22 downward, and a pressure applied from a polishing pressure regulator (not shown) to the semiconductor wafer 22 is set.

The turn table 10 is rotated, and a polishing solution (slurry) 53 in which abrasive grains such as small silica grains having an average grain size of, for example, about 20 nm are dispersed in an alkali solution such as aqueous ammonia is supplied from the leading end of a supply nozzle 41 of the polishing solution supply unit 40 onto a substantially central portion of the polishing cloth 51 mounted on the turn table 10.

The polishing solution 53 supplied from the leading end of the supply nozzle 41 is spread from the central portion to a peripheral portion of the polishing cloth 51 by a centrifugal force due to rotation of the turn table 10, to fill up the small holes 52 of the irregularities 51*a* of the polishing cloth 51, and is scattered from the peripheral portion to the exterior of the polishing cloth 51.

Then, the holding base 20 on which the semiconductor wafer 22 is stuck is rotated, and is moved down to press a surface to be processed of the semiconductor wafer 22 on the polishing cloth 12 mounted on the turn table 10 at a predetermined pressure, thus starting planarization for the surface to be processed of the semiconductor wafer 22.

After the surface to be processed of the semiconductor wafer 22 is polished a specific amount, the holding base 20 is moved up, followed by stoppage of rotation of both the holding base 20 and the turn table 10 and stoppage of supply of the polishing solution 53. Then, the semiconductor wafer 22 is separated from the underside of the holding base 20.

Thus, semiconductor wafers 22 are sequentially planarized by repeating the above steps.

According to the CMP apparatus 50 using the polishing cloth 51, since the supply characteristic of the polishing solution 53 on a surface to be processed is ensured by the presence of the small holes 52 of the irregularities 51*a*, it is possible to eliminate the need of dressing of the polishing cloth 12 by the dressing plate 30 as in the related art CMP apparatus 1 after planarization of a large number of semiconductor wafers 22.

As described above, since the CMP apparatus 50 includes the polishing cloth 51 having a large number of the irregularities 51*a* formed by arranging the small holes 52 of a specific depth at specific intervals in the surface portion of the polishing cloth 51, it is possible to planarize a large number of semiconductor wafers 22 without the need of the dressing step using the dressing plate 30 as in the related art CMP apparatus 1, and hence to improve the working ratio of the CMP apparatus 50.

Further, in the CMP apparatus 50, since the dressing step is not required to be provided, it is possible to eliminate the cause of occurrence of microscratches on an interlayer insulating film 22*b* of a semiconductor wafer 22 as a substrate to be processed due to shavings of the polishing cloth and large grains such as hard grains peeled from the underside of the dressing plate upon dressing, and further, since the interlayer insulating film 22*b* of the semiconductor wafer 22 is prevented from being in contact with large grains 57 such as flakes of silicon entrapped in the polishing solution 53 in the small hole 52 produced upon planarization of the semiconductor wafer 22 by setting the depth of the small holes 52 to be more than the opening diameter of the small holes 52, it is possible to reduce the cause of occurrence of microscratches due to the large grains.

Accordingly, it is possible to prevent the yield in fabrication of highly integrated semiconductor devices necessitating planarization from being lowered due to the deterioration of withstand voltage of the interlayer insulating film 22*b* of the semiconductor wafer 22 caused by occurrence of microscratches.

While the preferred embodiment of the present invention has been described using specific terms, such description is for illustrative purposes only, and it is to be understood that changes and variations may be made without departing the spirit or scope of the present invention.

For example, in the embodiment of the present invention, the CMP apparatus is used for planarization of a surface to be processed of a semiconductor wafer; however, it may be used for planarization of a TFT active matrix substrate of a liquid crystal display, or the like.

In the embodiment of the present invention, the polishing cloth is made from a polyurethane resin; however, it may be made from a material selected from other hard resins and hard rubbers.

In the embodiment of the present invention, the thickness of the polishing cloth is set at about 3 mm and the irregularities are formed by arranging the small holes in the surface portion of the polishing cloth; however, the thickness of the polishing cloth is set to be less than the depth of the small holes, that is, the small holes may be set to pass through the polishing cloth.

As described above, according to the CMP apparatus of the present invention, since the polishing cloth has the irregularities formed by arranging a large number of the small holes in the surface portion thereof, it is possible to eliminate the need of provision of the dressing step using the dressing plate for coarsening the polishing cloth, and hence to improve the working ratio of the CMP apparatus.

Further, according to the CMP apparatus of the present invention, since planarization is performed using the polishing cloth having the irregularities formed by arranging a large number of the small holes in the surface portion thereof, it is possible to suppress occurrence of microscratches on a surface to be processed of a semiconductor wafer, and hence to improve the yield in fabrication of highly integrated semiconductor devices using the CMP apparatus at the planarization step.

What is claimed is:

1. A chemical-mechanical polishing apparatus comprising:

a polishing cloth of a hard resin in which a plurality of small holes having a specific depth are arranged at specific intervals;

a turn table on which said polishing cloth is mounted;

a holding base for holding a substrate to be processed; and a polishing solution supply unit for supplying a polishing solution.

2. A chemical-mechanical polishing apparatus according to claim 1, wherein said specific depth H of said small holes is in a range of 30 $\mu m \leqq H \leqq 5$ mm.

3. A chemical-mechanical polishing apparatus according to claim 1, wherein said specific depth H of said small holes is in a range of 30 $\mu m \leqq H \leqq 3$ mm.

4. A chemical-mechanical polishing apparatus according to claim 1, wherein said specific depth H of said small holes is in a range of 30 $\mu m \leqq H \leqq 2$ mm.

5. A chemical-mechanical polishing apparatus according to claim 1, wherein said specific interval P between said small holes is in a range of 20 $\mu m \leqq P \leqq 5$ mm.

6. A chemical-mechanical polishing apparatus according to claim 1, wherein said specific interval P between said small holes is in a range of 20 $\mu m \leqq P \leqq 3$ mm.

7. A chemical-mechanical polishing apparatus according to claim 1, wherein said specific interval P between said small holes is in a range of 20 $\mu m \leqq P \leqq 2$ mm.

8. A chemical-mechanical polishing apparatus according to claim 1, wherein said small holes formed in said polishing cloth are circular small holes arranged in a delta-shaped pattern.

9. A chemical-mechanical polishing apparatus according to claim 1, wherein said small holes formed in said polishing cloth pass through said polishing cloth.

10. A chemical-mechanical polishing apparatus according to claim 1, wherein a ratio of an area of said polishing cloth excluding said small holes to a total area of said polishing cloth is 60% or less.

11. A chemical-mechanical polishing apparatus comprising:

a polishing cloth in which a plurality of small holes having a specific depth H are arranged at specific intervals P, said interval P being in a range of 20 $\mu m \leqq P \leqq 5$ mm;

a turn table on which said polishing cloth is mounted;

a holding base for holding a substrate to be processed; and a polishing solution supply unit for supplying a polishing solution.

12. A chemical-mechanical polishing apparatus according to claim 11, wherein said specific depth H of said small holes is in a range of 30 $\mu m \leqq H \leqq 5$ mm.

13. A chemical-mechanical polishing apparatus according to claim 11, wherein said small holes formed in said polishing cloth are circular small holes arranged in a delta-shaped pattern.

14. A chemical-mechanical polishing apparatus according to claim, 11, wherein said small holes formed in said polishing cloth pass through said polishing cloth.

15. A chemical-mechanical polishing apparatus according to claim 11, wherein a ratio of an area of said polishing cloth excluding said small holes to a total area of said polishing cloth is 60% or less.

16. A chemical-mechanical polishing apparatus comprising:

a polishing cloth in which a plurality of small holes having a specific depth are arranged at specific intervals with a ratio of an area of said polishing cloth excluding said small holes to a total area of said polishing cloth being 60% or less;

a turn table on which said polishing cloth is mounted;

a holding base for holding a substrate to be processed; and a polishing solution supply unit for supplying a polishing solution.

17. A chemical-mechanical polishing apparatus according to claim 16, wherein said specific depth H of said small holes is in a range of 30 $\mu m \leqq H \leqq 5$ mm.

* * * * *